US008373122B2

(12) United States Patent
Kholine et al.

(10) Patent No.: US 8,373,122 B2
(45) Date of Patent: Feb. 12, 2013

(54) SPHEROIDAL CHARGED PARTICLE ENERGY ANALYSERS

(75) Inventors: Nikolay Alekseevich Kholine, Saint-Petersburg (RU); Dane Cubric, Manchester (GB); Ikuo Konishi, Nara (JP)

(73) Assignee: Shimadzu Research Laboratory (Europe) Ltd, Manchester (GB)

( * ) Notice: Subject to any disclaimer, the term of this patent is extended or adjusted under 35 U.S.C. 154(b) by 0 days.

(21) Appl. No.: 12/739,513

(22) PCT Filed: Mar. 31, 2008

(86) PCT No.: PCT/GB2008/001117
§ 371 (c)(1),
(2), (4) Date: Mar. 9, 2011

(87) PCT Pub. No.: WO2009/053666
PCT Pub. Date: Apr. 30, 2009

(65) Prior Publication Data

US 2011/0147585 A1 Jun. 23, 2011

(30) Foreign Application Priority Data

Oct. 24, 2007 (GB) ..... 0720901.8

(51) Int. Cl.
*H01J 40/00* (2006.01)

(52) U.S. Cl. ..... 250/305

(58) Field of Classification Search ..... 250/305, 250/396 R, 397
See application file for complete search history.

(56) References Cited

U.S. PATENT DOCUMENTS 3,699,331 A * 10/1972 Palmberg ..... 250/305
(Continued)

FOREIGN PATENT DOCUMENTS

JP 2005 085540 3/2005
RU 2 294 579 12/2006
(Continued)

OTHER PUBLICATIONS

Kakiuchi et al: "Development of an electron electron ion coincidence analyzer for Auger photoelectron coincidence spectroscopy (APECS) and electron ion coincidence (EICO) spectroscopy" Journal of Electron Spectroscopy and Related Phenomena, Elsevier Science Publishers, Amsterdam, NL, vol. 161, No. 1-3, Oct. 6, 2007, pp. 164-171, XP022288982, ISSN: 0368-2048, the whole document.

(Continued)

*Primary Examiner* — Robert Kim
*Assistant Examiner* — Jason McCormack
(74) *Attorney, Agent, or Firm* — Stites & Harbison PLLC; Marvin Petry

(57) ABSTRACT

Charged particle energy analysers enabling simultaneous high transmission and energy resolution are described. The analysers have an electrode structure (11) comprising coaxial inner and outer electrodes (14, 15) having inner and outer electrode surfaces (IS, OS) respectively. The inner and outer electrode surfaces are defined, at least in part, by spheroidal surfaces having meridonal planes of symmetry orthogonal to a longitudinal axis of the electrode structure (11). The inner and outer electrode surfaces are generated by rotation, about the longitudinal axis, of arcs of two non-concentric circles having different radii $R_2$ and $R_1$ respectively, $R_2$ being greater than $R_1$. The distance of the outer electrode surface from the longitudinal axis in the respective meridonal plane is $R_{01}$ and the distance of the inner electrode surface from the longitudinal axis in the respective plane is $R_{02}$ and $R_1$, $R_2$, $R_{01}$ and $R_{02}$ have a defined relationship.

23 Claims, 4 Drawing Sheets

U.S. PATENT DOCUMENTS

Figure 1:
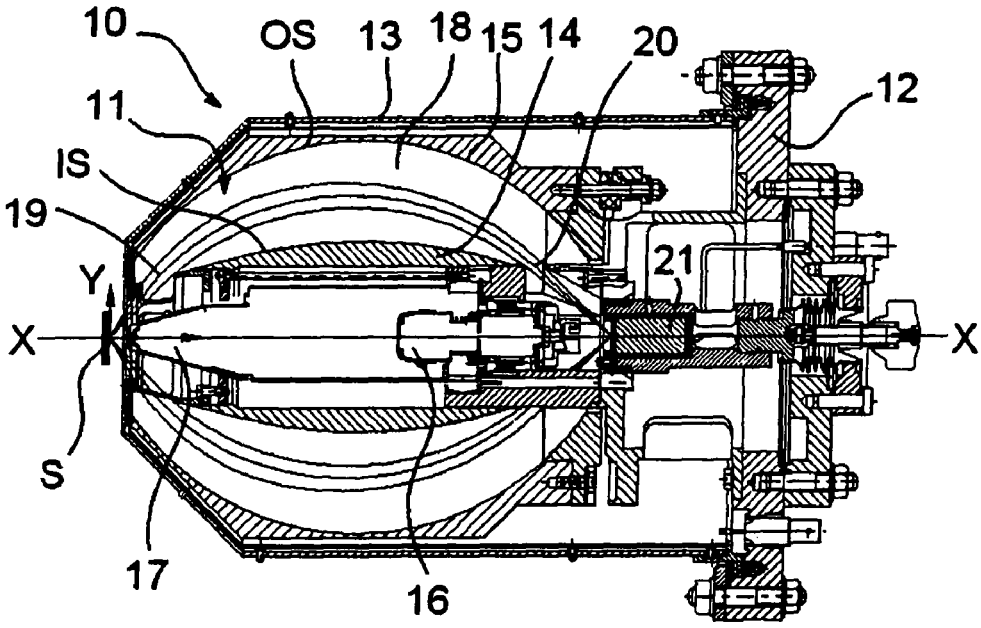

| | | | | |
|---|---|---|---|---|
| 3,783,280 | A * | 1/1974 | Watson | 250/305 |
| 3,787,280 | A | 1/1974 | Conger et al. | |
| 4,758,722 | A * | 7/1988 | Leckey et al. | 250/305 |
| 6,184,523 | B1 * | 2/2001 | Dowben et al. | 250/305 |
| 2005/0045832 | A1 * | 3/2005 | Kelly et al. | 250/397 |
| 2007/0108390 | A1 * | 5/2007 | Radovanov et al. | 250/396 R |
| 2008/0042057 | A1 * | 2/2008 | Sanada et al. | 250/305 |
| 2008/0290287 | A1 * | 11/2008 | David | 250/396 R |
| 2010/0001202 | A1 * | 1/2010 | Matsuda et al. | 250/396 R |

FOREIGN PATENT DOCUMENTS

| | | | |
|---|---|---|---|
| RU | 2 294 579 | | 2/2007 |
| SE | 512 265 | | 2/2000 |
| SE | 512265 | * | 2/2000 |
| SU | 1 304 106 | | 4/1987 |
| SU | 1 376 833 | | 6/1989 |
| WO | WO 93/16486 | | 8/1993 |

OTHER PUBLICATIONS

International Search Report—Corrected Version, issued Jun. 29, 2009 for WO 2009/053666, European Patent Office, Rijswijk, Netherlands.

International Search Report for PCT/GB2008/001117.

Written Opinion of the International Searching Authority for PCT/GB2008/001117.

* cited by examiner

SPHEROIDAL CHARGED PARTICLE ENERGY ANALYSERS

This invention relates to analytical instrumentation. More specifically, the invention relates to charged particle energy analysers.

Charged particle energy analysers find application in research and industry and can be used to determine the atomic composition and properties of substances by recording energy spectra of charged particles extracted from them, for example. Charged particle energy analysers find particular, though not exclusive, application in Electron Spectroscopy for Chemical Analysis (ESCA) including Auger Electron Spectroscopy (AES). In such analysis, a sample placed in a vacuum and exposed to X-rays, electrons or ions emits photoelectrons, X-rays, secondary electrons Auger electrons (a special class of secondary electrons) ions, and elastically scattered electrons from a primary electron source.

Charged particles emitted from a surface of a sample can be separated according to their energies and detected in the form of spectra. Such energy spectra are characteristic of the sample material and therefore contain important information about the composition of the sample.

The particles may be separated according to energy using electric or electromagnetic energy analysers. The most common analysers are electrostatic analysers of the hemispherical deflector and cylindrical mirror types. The hemispherical deflector analyser is usually used in X-ray or UV electron spectroscopy which requires high resolution. The cylindrical mirror analyser, which provides a higher acceptance solid angle as compared with the hemispherical deflector analyser is usually preferred for Auger electron spectroscopy of moderate resolution with electron impact excitation.

In known high acceptance, cylindrical mirror analysers, electrons that are to be analysed are emitted from the sample in the form of a divergent beam and are deflected relative to the axis of the analyser by the electric field between coaxial cylindrical electrodes. Electrons within a narrow energy range defined by the outer electrode potential and analyser resolution are focused at a specified point on the axis or at a ring around it where they are collected and detected. The energy spectrum of the electrons is obtained by varying the field potential and detecting the electrons as a function of this potential. A disadvantage of the known cylindrical mirror analyser is that its high acceptance, typically 14% per $2\pi$ sterradians, is attainable only at low energy resolution, typically 0.5% of the energy of interest. Both high acceptance and high resolution cannot be attained simultaneously.

Traditionally, electron spectroscopy analysis is usually performed either at high resolution at the expense of lower acceptance (and hence sensitivity) as in the case of a hemispherical deflector analyser or at high acceptance (sensitivity) and at a limited resolution as in the case of a cylindrical mirror analyser.

Apart from acceptance and energy resolution there are many other requirements arising from arrangement of research work including simplicity of analytical systems and others.

A known analyser which combines both high acceptance solid angle and high energy resolution is described by Siegbahn et al., Nucl. Instr. Meth. A 348 (1997) 563-574. This analyser combines both axial and radial electric fields in a cylindrically symmetric analyser (Swedish Patent No, 512265, C.H01J, 49/40, 1997). The inner and outer coaxial electrode surfaces follow equipotential surfaces obtained from theoretical considerations. In this known analyser the field structure and equipotential surfaces of electrodes were obtained by solving Laplace equation for cylindrically symmetric systems with the condition that the solution of the Laplace equation is the sum of the two functions, one dependent only on radial distance and the other dependent only on axial distance. This resulted in a field structure with both an axial and a radial field gradient. Analyzers based on such field properties are certainly superior to classical cylindrical mirror analyzers in performance, but they are restricted by the limiting nature of the field structure which is constrained by the requirement for separate field distribution functions which vary independently in the radial and axial directions.

According to the invention there is provided a charged particle energy analyser comprising irradiation means for irradiating a sample for causing the sample to emit charged particles for energy analysis, an electrode structure having a longitudinal axis, the electrode structure comprising coaxial, inner and outer electrodes having inner and outer electrode surfaces respectively, an entrance opening through which charged particles emitted from said sample can enter a space between said inner and outer electrode surfaces for energy analysis and an exit opening through which charged particles can exit said space, and detection means for detecting charged particles that exit said space through said exit opening, wherein said inner and outer electrode surfaces are defined, at least in part, by spheroidal surfaces having meridonal planes of symmetry orthogonal to said longitudinal axis, said inner and outer electrode surfaces being generated by rotation, about said longitudinal axis, of arcs of two non-concentric circles having different radii, $R_2$ and $R_1$ respectively, $R_2$ being always more than $R_1$, the distance of said outer electrode surface from said longitudinal axis in the respective meridonal plane being $R_{01}$ and the distance of said inner electrode surface from said longitudinal axis in the respective meridonal plane being $R_{02}$, and wherein said radii $R_1$ and $R_2$ and said distance $R_{02}$ satisfy the conditions:

$$R_1=K_1R_{12}$$

$$R_2=K_2R_{12},$$

$$R_{02}=K_3R_{12},$$

where $R_{12}=R_{01}-R_{02}$ and $K_1$, $K_2$ and $K_3$ are dimensionless parameters for which $1<K_1<\infty$, $1<K_2\leqq\infty$ and $0<K<\infty$, where any selected set of the parameters satisfy $K_1\neq 1+K_2$ and $K_1<K_2$ and $K_3<K_2$.

Adopting this novel mode of expression, it will be noted that the known hemispherical deflector analyser (HDA) has electrode surfaces for which $K_1=1+K_2$ and $K_2=K_3$. The known cylindrical mirror analyser (CMA), on the other hand, has electrode surfaces for which $K_1=K_2=\infty$.

The present invention provides a range of hitherto unknown charged particle energy analysers having spheroidal electrode surfaces, which will be referred to hereinafter as Spheroidal Energy Analyzers (SEA).

Some preferred embodiments of the SEA are found to be particularly advantageous because they offer the benefit of both high energy resolution (typically better than 0.5% at the base of the spectral line), usually associated with the HDA, and high acceptance solid angle (typically better than 14% per $2\pi$ sterradians), usually associated with the CMA, in the same analyser.

Furthermore, the SEA has a geometry which is not constrained by the requirement for separate field distribution functions which vary independently in the radial and axial directions, as is the case in the analyser described in the aforementioned publications.

In preferred embodiments, values of $K_1$, $K_2$ and $K_3$ preferably satisfy the conditions: $1<K_1\leqq 10$, $1<K_2\leqq\infty$ and $0.1\leqq K_3<3$. In a particularly preferred embodiment $K_1=2.756$, $K_2=4.889$ and $K_3=0.944$ the analyser being capable of simultaneously giving an energy resolution $\Delta E/E$ of at least 0.05% at the base of the spectral line and an acceptance solid angle not less than 21% per $2\pi$ sterradians.

Figure 2:
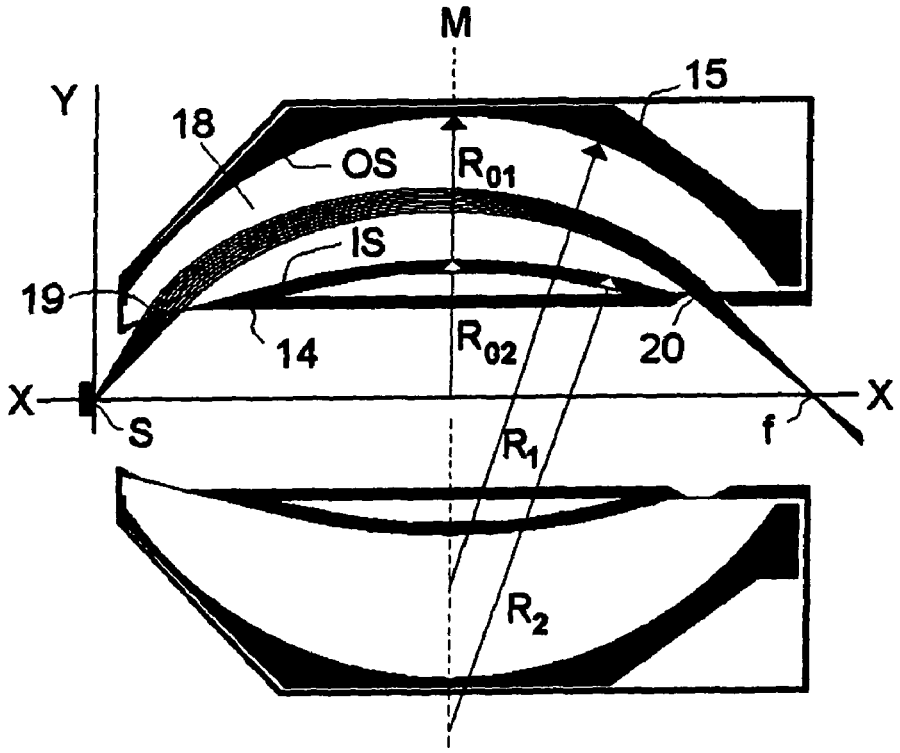
Figure 3:
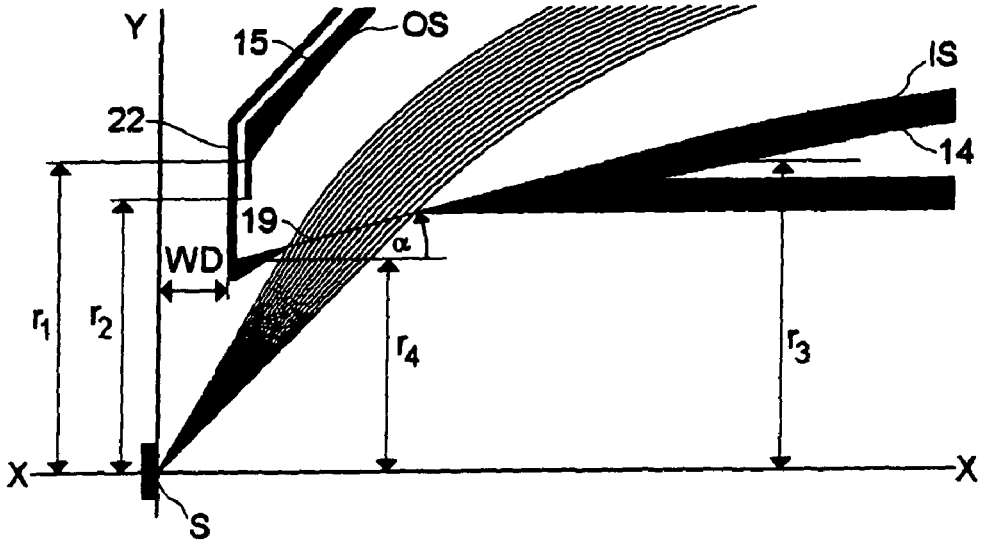
Figure 4:
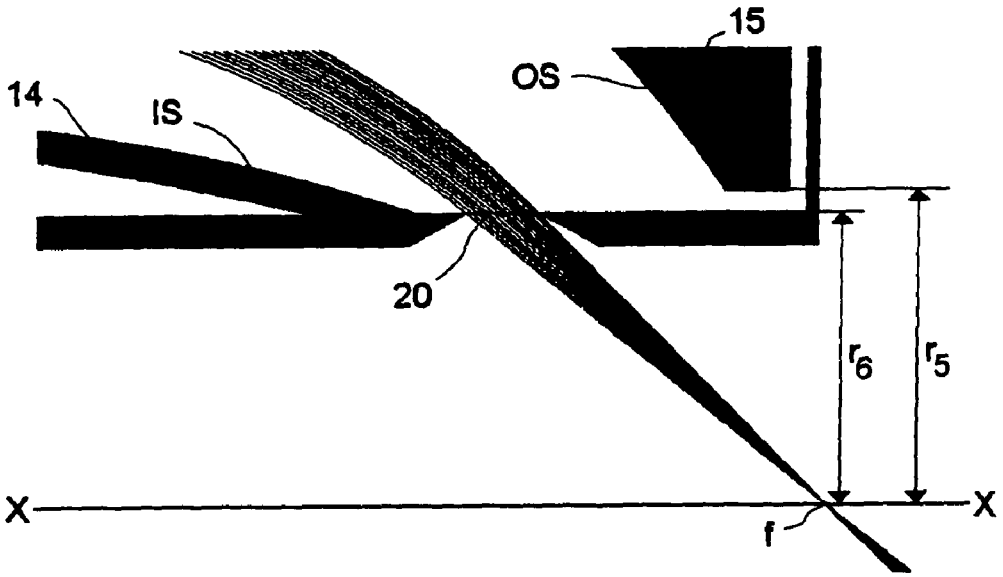
Figure 5:
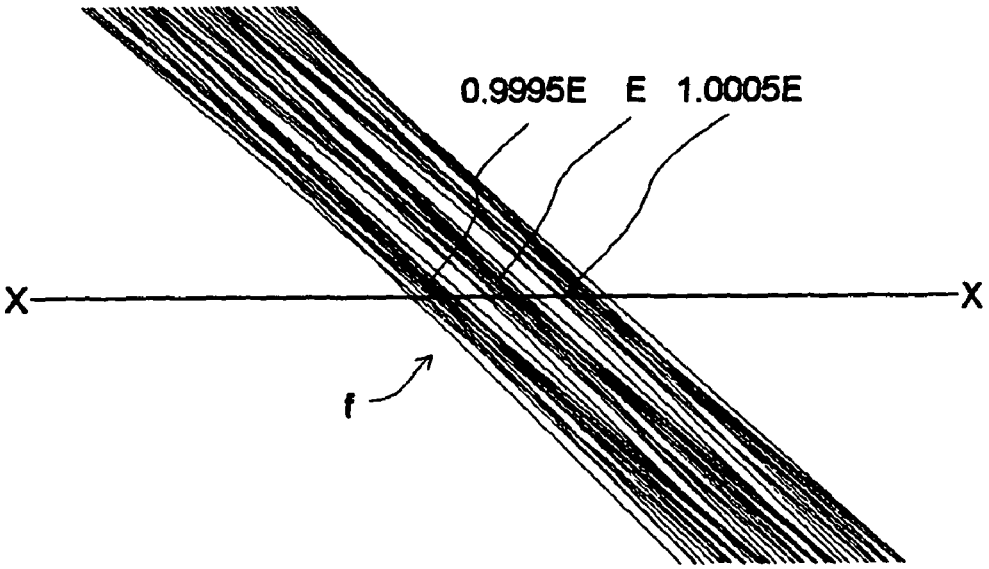
Figure 6:
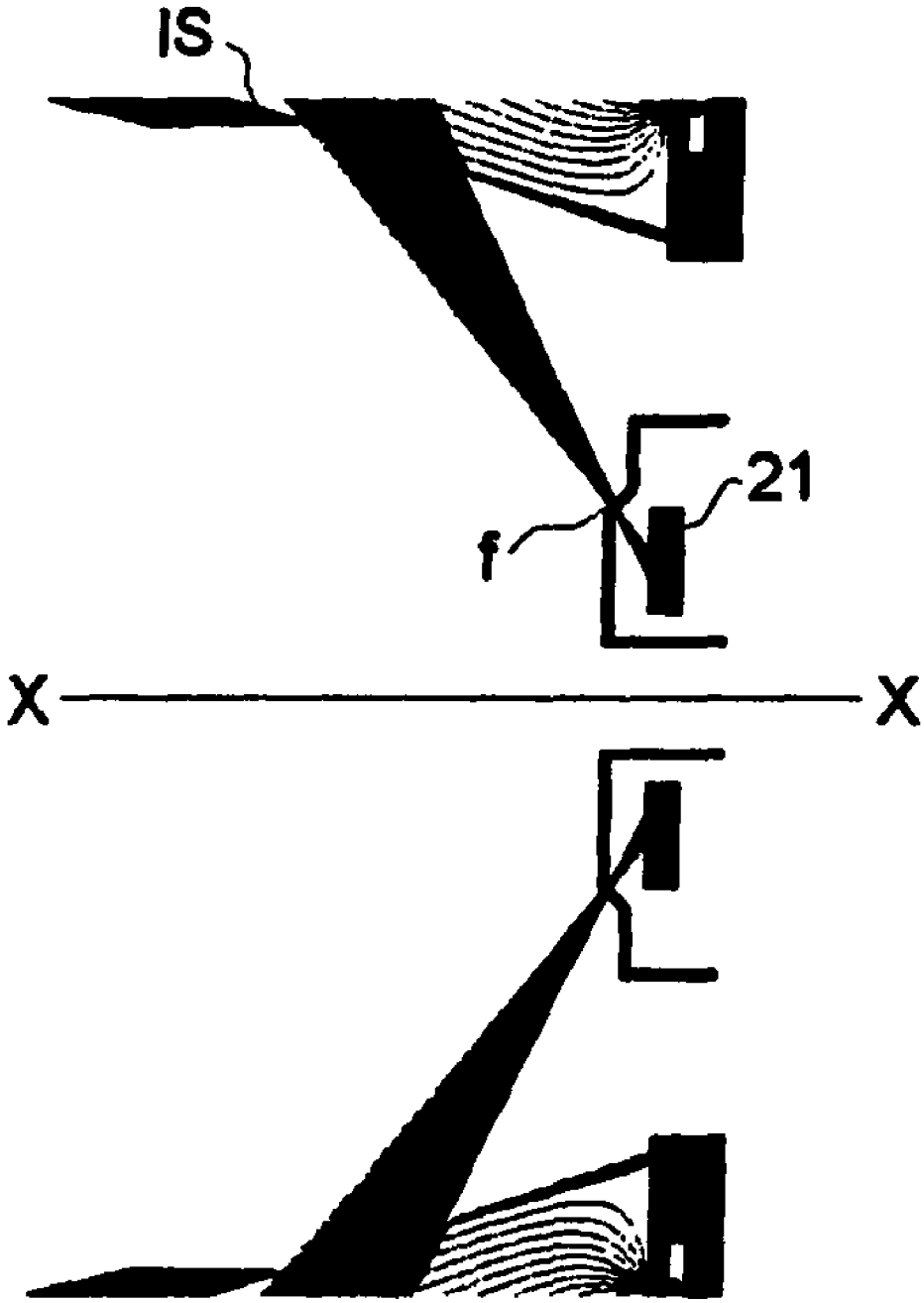

Embodiments of the invention are now described, by way of example, only, with reference to the accompanying drawings of which:

FIG. 1 shows a simplified longitudinal sectional view of an embodiment of a Spheroidal Energy Analyser (SEA) according to the invention, FIG. 2 shows a detailed longitudinal sectional view of the electrode structure of the SEA shown in FIG. 1, FIG. 3 shows a more detailed view of the entrance end of the electrode structure shown in FIG. 2, FIG. 4 shows a more detailed view of the exit end of the electrode structure shown in FIG. 2, FIG. 5 shows the trajectories of electrons having energies E and E±0.05% where they cross the longitudinal axis of the SEA following energy analysis, and FIG. 6 shows a detailed view of the exit end of a modified electrode structure of which the inner electrode surface has a conically-shaped end portion.

Referring to FIG. 1 of the drawings, the charged particle energy analyser 10 has an electrode structure 11 mounted on a flanged support plate 12. Plate 12 also supports a magnetic shield 13 which encloses the electrode structure 11 shielding it from extraneous magnetic fields which might otherwise distort the trajectories of charged particles as they pass through the analyser.

The electrode structure 11 comprises an inner electrode 14 and an outer electrode 15. The inner electrode 14 has an inner electrode surface IS and the outer electrode 15 has an outer electrode surface OS, the inner and outer electrode surfaces IS, OS being rotationally symmetric about a longitudinal axis X-X of the analyser. A sample S located on the longitudinal axis X-X is irradiated with electrons. To that end, the analyser includes a primary electron source 16 which is part of an electron gun 17 for directing primary electrons, generated by the source, onto a surface of sample S. Secondary electrons emitted by the sample enter a space 18 between the inner and outer electrode surfaces IS, OS via an entrance opening 19 in the inner electrode 14, and electrons exit space 18 via an exit opening 20 in the inner electrode 14 for detection by a detector 21. FIG. 1 shows three exemplary trajectories of electrons as they pass between the inner and outer electrode surfaces IS, OS.

In this embodiment, the sample S is irradiated with electrons. However, it will be appreciated that alternative irradiation means could be used; for example, the sample could be irradiated with positively or negativity charged ions, X-rays, laser light or UV light.

For energy analysis of negatively charged particles, (for example electrons, as in the described embodiment), the outer electrode 15 is held at a negative potential relative to the inner electrode 14, whereas for energy analysis of positively charged particles the outer electrode 15 is held at a positive potential relative to the inner electrode 14. The inner electrode 14 could be held at ground potential, and in this case only a single power supply would be needed.

The potential difference between the inner and outer electrodes 14, 15 determines the energy of charged particles brought to a focus at the detector 21 by the energy dispersive electric field created in space 18 between the inner and outer electrode surfaces IS, OS. In a scanning mode of operation, the potential difference may be scanned to produce an energy spectrum.

FIGS. 2 to 4 illustrate the shape of the inner and outer electrode surfaces IS, OS in greater detail. Apart from end portions, the inner and outer electrode surfaces IS, OS are spheroidal, each surface being defined by rotating an arc of a circle about the longitudinal axis X-X. Each spheroidal surface has a meridonal plane of symmetry M which is orthogonal to the longitudinal axis. In this embodiment, the meridonal planes of symmetry M of the inner and outer electrode surfaces IS, OS are coincident, although it will be appreciated that this need not necessarily be so. With particular reference to FIG. 3, the outer electrode surface OS of this embodiment has a flat, annular end portion which truncates the spheroidal portion of the outer electrode surface OS at the entrance end of the analyser. The flat, annular end portion is centred on the longitudinal axis X-X and has an outer radius $r_1$, and an inner radius $r_2$.

The inner electrode surface IS has a coaxial, conically-shaped end portion which truncates the spheroidal portion of the inner electrode surface IS at the entrance end of the analyser. The conically-shaped end portion has a radius $r_3$ where it meets the spheroidal portion of the inner electrode surface tangentially, and a radius $r_4$ where it is truncated by a flat end face of the inner electrode surface. The coaxial, conically-shaped end portion subtends a half angle $\alpha$.

With particular reference to FIG. 4, the outer electrode surface OS has a coaxial, cylindrical end portion of radius $r_5$ which truncates the spheroidal portion of the outer electrode surface OS at the exit end of the analyser. Similarly, the inner electrode surface IS has a coaxial, cylindrical end portion of radius $r_6$ which truncates the spheroidal portion of the inner electrode surface IS at the exit end of the analyser.

As shown in FIG. 1 to 4, the entrance opening 19 is located in the coaxial, conically-shaped end portion of the inner electrode surface IS and the exit opening 20 is located in the coaxial, cylindrical end portion of the inner electrode surface IS. In this embodiment, the entrance and exit openings 19, 20 are covered with high transparency grids, typically formed by longitudinally-extending, electrically conductive wires.

Referring to FIG. 2, the spheroidal portion of the outer electrode surface OS is defined by rotation of an arc of a circle of radius $R_1$ and the distance $R_{01}$ of that arc from the longitudinal axis X-X measured in the meridonal plane M, and the spheroidal portion of the inner electrode surface IS is defined by rotation of an arc of a circle of radius $R_2$ and the distance $R_{02}$ of that arc from the longitudinal axis X-X, again measured in the meridonal plane M.

$R_1$, $R_2$ and $R_{02}$ satisfy the conditions:

$$R_1=K_1R_{12}$$

$$R_2=K_2R_{12}$$

and $$R_{02}=K_3R_{12}$$

where $R_{12}=R_{01}-R_{02}$ is the gap between the inner and outer electrodes surfaces IS, OS in the meridonal plane M and $K_1$, $K_2$ and $K_3$ are dimensionless parameters. As shown in FIGS. 1 to 3, sample S is located outside the bounds of the electrode structure 11. This arrangement is advantageous because it enables the sample to be positioned with relative ease and facilitates the provision of one or more additional irradiation source; for example, an X-ray irradiation source could be provided in addition to the primary electron source. It will be appreciated that in alternative, less preferred embodiments, the sample S could be located within the bounds of the electrode structure.

In a particularly preferred embodiment of the invention, $K_1$=2.756, $K_2$=4.889 and $K_3$=0.944. For these values of $K_1$, $K_2$ and $K_3$, the flat annular end portion of the outer electrode surface OS preferably has an outer radius $r_1=0.755R_{12}$ and an inner radius $r_2=0.661R_{12}$, and the conically-shaped end portion of the inner electrode surface IS preferably has a radius $r_3=0.818R_{12}$, a radius $r_4=0.515R_{12}$ and a half angle $\alpha\approx14.3°$ for which $\tan(\alpha)=0.255$.

At the exit end of the analyser the coaxial, cylindrical end portion of the outer electrode surface OS preferably has a radius $r_5=0.754R_{12}$ and the coaxial, cylindrical end portion of the inner electrode surface IS preferably has a radius $r_6=0.704R_{12}$.

In a particular example of the preferred embodiment (for which $K_1$=2.756, $K_2$=4.889 and $K_3$=0.944), $R_{12}$ is set at 45 mm, and so $R_1$ has the value 124 mm, $R_2$ has the value 220 mm, $R_{01}$ has the value 87.5 mm and $R_{02}$ has the value 43.5 mm.

Adopting a cylindrical (XY) coordinate system for this example, in which the origin is centred on the longitudinal axis X-X at the sample, X is the axial distance and Y is the radial distance in a direction orthogonal to the longitudinal axis, the working distance (WD) of the analyser; that is, the axial distance between the sample S and the front face 22 of the analyser, is set at 7.6 mm. In the example, the annular end portion of the outer electrode surface OS, at the entrance end of the analyser, has an inner radial edge at the X;Y coordinates 9.90 mm; 29.75 mm and an axial depth of 0.40 mm, and the coaxial, conically-shaped end portion of the inner electrode surface IS, at the entrance end of the analyser, is truncated by flat end face of the inner electrode surface IS at the X;Y coordinates 8.50 mm; 23.150 mm. The cylindrical end portion of the outer electrode surface OS truncates the spheroidal portion of the outer electrode surface OS at the X;Y coordinates 214.05 mm; 33.95 mm and has an axial length of 6.90 mm. Similarly, the cylindrical end portion of the inner electrode surface IS truncates the spheroidal portion of the inner electrode surface IS at the X;Y coordinates 180.00 mm; 31.70 mm and intersects a flat end face at the exit end of the analyser at the X;Y coordinates 222.95 mm; 31.70 mm.

In this example, electrons enter space 18 between the inner and outer electrode surfaces IS, OS through the entrance opening 19 on trajectories having divergence angles in the range 44° to 60°, and electrons exit space 18 via the exit opening 20 on trajectories having divergence angles in the range 38.6° to 45.1° and are brought to a focus at a focal point, f, having the X;Y coordinates 225.27 mm; 0.0 mm.

The electric field pattern created between the inner and outer electrode surfaces IS, OS and energy dispersive and focusing properties of that field can be determined by simulation, using a charged particle optical simulation program, such as SIMION3D, for example.

It has been found that the described example of the preferred embodiment gives high energy resolution ΔE/E typically 0.05% at the base of the spectral line which is much higher than the energy resolution that can be achieved using a known cylindrical mirror analyser (typically 0.5%).

This high energy resolution is demonstrated by FIG. 5 which shows that the trajectories of electrons having energies 0.9995E, E and 1.0005E are separated by the analyser into three clearly resolvable bundles where they cross the longitudinal axis following energy analysis.

The described example also has a high acceptance solid angle, typically not less than 21% per 2π sterradians which is much higher than the acceptance solid angle typically provided by the known hemispherical deflector analyser (typically 1%). Therefore, the described example is especially advantageous because it offers the benefit of both high energy resolution and high acceptance solid angle in the same instrument.

The detector 21 may be a channeltron or any other charged particle detection device providing a multiplication function. As will be apparent from FIG. 5, the described analyser offers a multi-channel function and so the detector may have the form of a multi-channel plate device or any other multi-channel charged particle detection device providing position-sensitive detection.

Charged particle optical simulation studies have shown that higher values of energy resolution are generally achievable within the preferred embodiments that have values of $K_1$, $K_2$ and $K_3$ satisfying the conditions:

$$1<K_1\leqq10,$$

$$1<K_2\leqq\infty$$

and $$0.1\leqq K_3\leqq3.$$

By way of example, one preferred embodiment, for which $K_1$=1.692, $K_2=\infty$ and $K_3$=0.436, gives an energy resolution ΔE/E of about 0.3% at the base of the spectral line and has an acceptance angle of about 15% per 2π sterradians, and another preferred embodiment, for which $K_1$=1.784, $K_2$=8.919 and $K_3$=0.514, gives an energy resolution ΔE/E of about 0.3% at the base of the spectral line and has an acceptance solid angle of about 24% per 2π sterradians.

As already described, a particularly preferred embodiment, for which $K_1$=2.756, $K_2$=4.889 and $K_3$=0.944, can give an energy resolution ΔE/E of at least 0.05% at the base of the spectral line and an acceptance angle of not less than 21% per 2π sterradians. In this case, an even higher energy resolution of less than 0.0025% can be attained if the acceptance solid angle is reduced to about 7% per 2π sterradians by reducing the size of the entrance and exit openings. Conversely, a higher acceptance angle of about 30% per 2π sterradians can be attained by increasing the size of the entrance and exit slits, although this would reduce the energy resolution to about 0.07%

The non-spheroidal end portions of the described inner and outer electrode surfaces IS, OS are designed to reduce adverse effects of fringing fields within space 18 between the electrode surfaces. It will be appreciated that these portions may have alternative forms. For example, the conically-shaped end portion of the inner electrode surface could alternatively have a non-conical shape, such as a cylindrical shape and/or the cylindrical end portion of the inner electrode surface could alternatively have a non-cylindrical shape. In particular, the cylindrical end portion of the inner electrode surface could be replaced by a truncated conical end portion. In this case, for example, the charged particles could be brought to a focus at a ring encircling the longitudinal axis X-X, as shown in FIG. 6, and the detector 21 would have the form of a ring detector. The focusing at a ring encircling the longitudinal axis X-X is advantageous because the axial region of the analyser could be free from mechanical obstruction allowing sample S to be irradiated using a primary excitation beam (e.g an electron beam) directed along or near to the longitudinal axis of the analyser from an irradiation source external to the electrode structure 11.

Although the provision of such non-spheroidal electrode surfaces at the entrance and exit ends of the analyser is considered to give optimum results, such non-spheroidal surfaces could be omitted altogether and a useful analyser would still be obtained.

The described electrode structure 11 has a simple construction with the energy dispersive field being defined by only two electrodes although additional electrodes could alternatively (through less desirably) be used.

The embodiments that have been described have inner and outer electrode surfaces IS, OS that are rotationally symmetric about the longitudinal axis; that is, the two electrode surfaces extend over the entire (360°) azimuthal angular range. Alternatively, the inner and outer electrode surfaces may extend over a smaller azimuthal angular range e.g. 270°, 180° or even smaller, although in these cases care needs to be taken to compensate for fringing fields created by the electrode structure at the extremes of the angular range.

Two or more charged particle energy analysers according to the invention may be combined to create a double pass or multiple pass instrument. In this case, two or more analysers would be coupled together along their common axis of symmetry, in such manner that the exit focusing point of one analyser represents a source point for the following analyser. Referencing a single analyser entrance as front F and exit as back B, to preserve consistency between the divergence angles at the entrance and exit ends in a double pass analyser the individual analysers should be arranged as F-B-B-F and similarly in a multiple pass analyser they should be arranged as F-B-B-F-F-B . . . .

The invention claimed is:

1. A charged particle energy analyser comprising irradiation means for irradiating a sample for causing the sample to emit charged particles for energy analysis, an electrode structure having a longitudinal axis, the electrode structure comprising coaxial, inner and outer electrodes having inner and outer electrode surfaces respectively, an entrance opening through which charged particles emitted from said sample can enter a space between said inner and outer electrode surfaces for energy analysis and an exit opening through which charged particles can exit said space, and detection means for detecting charged particles that exit said space through said exit opening, wherein said inner and outer electrode surfaces are defined, at least in part, by spheroidal surfaces having meridonal planes of symmetry orthogonal to said longitudinal axis, said inner and outer electrode surfaces being generated by rotation, about said longitudinal axis, of arcs of two non-concentric circles having different radii, $R_2$ and $R_1$ respectively, $R_2$ being always more than $R_1$, the distance of said outer electrode surface from said longitudinal axis in the respective meridonal plane being $R_{01}$ and the distance of said inner electrode surface from said longitudinal axis in the respective meridonal plane being $R_{02}$, and wherein said radii $R_1$ and $R_2$ and said distance $R_{02}$ satisfy the conditions:

$$R_1=K_1R_{12},$$

$$R_2=K_2R_{12}$$

and $$R_{02}=K_3R_{12},$$

where $R_{12}=R_{01}-R_{02}$ and $K_1$, $K_2$ and $K_3$ are dimensionless parameters for which $1<K_1<\infty$, $1<K_2\leqq\infty$ and, $0<K_3\leqq\infty$, where any selected set of the parameters satisfy $K_1\neq 1+K_2$ and $K_1<K_2$ and $K_3<K_2$.

2. A charged particle energy analyser as claimed in claim 1 wherein the meridonal planes of said spheroidal surfaces are coincident.

3. A charged particle energy analyser as claimed in claim 1 wherein $1<K_{1l}\leqq 10$, $1<K_2\leqq\infty$ and $0.1\leqq K_3\leqq 3$.

4. A charged particle energy analyzer as claimed in claim 3 wherein $K_1=2.756$, $K_2=4.889$ and $K_3=0.944$.

5. A charged particle energy analyser as claimed in claim 1 wherein said outer electrode surface has a flat, annular end portion at an entrance end of the electrode structure.

6. A charged particle energy analyser as claimed in claim 4 wherein said annular end portion comprises a flat ring having a circular aperture centered on said longitudinal axis.

7. A charged particle energy analyser as claimed in claim 6 wherein $K_1=2.756$, $K_2=4.889$ and $K_3=0.944$, said flat ring meets the spheroidal surface of said outer electrode surface at a radial coordinate $0.755R_{12}$, with respect to said longitudinal axis and said circular aperture has a radius $0.661R_{12}$, and an axial depth $0.009R_{12}$.

8. A charged particle energy analyser as claimed in claim 1 wherein said inner electrode surface has a coaxial, conically-shaped end portion at an entrance end of the electrode structure, said entrance opening being located in said coaxial, conically-shaped end portion.

9. A charged particle energy analyser as claimed in claim 8 wherein $K_1=2.756$, $K_2=4.889$ and $K_3=0.944$, said coaxial, conically-shaped end portion meets the spheroidal portion of said inner electrode surface tangentially at a radial coordinate $0.818R_{12}$ with respect to said longitudinal axis and has a half angle ($\alpha$) given by $\tan(\alpha)=0.255$.

10. A charged particle energy analyser as claimed in claim 9 wherein said inner electrode surface has an end face truncating said coaxial, conically-shaped end portion at a radial coordinate $0.514R_{12}$, with respect to said longitudinal axis.

11. A charged particle energy analyser as claimed in claim 1 wherein said inner electrode surface has a coaxial, cylindrically-shaped end portion at an exit end of the electrode structure, said exit opening being located in said cylindrically-shaped end portion whereby to enable focusing of charged particles emitted by the sample.

12. A charged particle energy analyser as claimed in claim 11 wherein said outer electrode surface has a coaxial, cylindrically-shaped end portion at said exit end of the electrode structure.

13. A charged particle energy analyser as claimed in claim 12 wherein the coaxial, cylindrically-shaped end portions of the outer and inner electrode surfaces have radii of $0.754R_{12}$ and $0.704R_{12}$ respectively.

14. A charged particle energy analyser as claimed in claim 1 wherein said inner electrode surface has a coaxial, conically-shaped end portion at an exit end of the electrode structure, said exit opening being located in said coaxial, conically-shaped end portion whereby charged particles emitted from said sample at a point on said longitudinal axis are brought to a focus at a ring centered on said longitudinal axis, said detection means being a ring detector for detecting the focused charged particles.

15. A charged particle energy analyser as claimed in claim 10 wherein said sample is positioned on said longitudinal axis at distance $0.169R_{12}$ from said end face and said entrance opening is dimensioned to admit charged particles emitted from the sample with divergence angles in the range from 44° to 60° with respect to said longitudinal axis.

16. A charged particle energy analyser as claimed in claim 15 wherein said exit opening is dimensioned to pass charged particles having divergence angles at least in the range from 38.6° to 45.1° with respect to the longitudinal axis, said charged particles being brought to a focus on the longitudinal axis at a focal point $5.006R_{12}$ from the sample.

17. A charged particle energy analyser as claimed in claim 1 wherein said entrance and exit openings are covered by electrically conductive grids.

18. A charged particle energy analyser as claimed in claim 17 wherein said electrically conductive grids have the form of longitudinally extending wires.

19. A charged particle energy analyser as claimed in claim 1 wherein said exit opening extends along the entire length of the cylindrically-shaped end portion.

20. A charged particle energy analyser as claimed in claim 1 wherein said detection means is a channeltron device.

21. A charged particle energy analyser as claimed in claim 1 wherein said detection means is a multichannel plate device.

22. A charged particle energy analyser as claimed in claim 1 wherein said detection means is a position-sensitive detection device.

23. A charged particle energy analysis instrument comprising a serial arrangement of two or more charged particle energy analysers, each according to claim 1, on a common longitudinal axis providing double or multipass charged particle energy analysis.

* * * * *

UNITED STATES PATENT AND TRADEMARK OFFICE

CERTIFICATE OF CORRECTION

PATENT NO. : 8,373,122 B2
APPLICATION NO. : 12/739513
DATED : February 12, 2013
INVENTOR(S) : Kholine et al.

It is certified that error appears in the above-identified patent and that said Letters Patent is hereby corrected as shown below:

In the specification:

Column 2, line 44, change "and $0<K<\infty$," to -- and $0<K_3<\infty$, --;

In the claims:

Column 8, line 2, Claim 1, change "and, $0<K_3\leq \infty$" to -- and, $0<K_3< \infty$ --;

Column 8, line 9, Claim 3, change "wherein $1<K_{1/\leq}10$," to -- wherein $1<K_1\leq 10$, --.

Signed and Sealed this
Twenty-fifth Day of June, 2013

Teresa Stanek Rea
*Acting Director of the United States Patent and Trademark Office*